US010996592B2

(12) United States Patent
Landa

(10) Patent No.: US 10,996,592 B2
(45) **Date of Patent: *May 4, 2021**

(54) METHOD FOR PRINTING ON THE OUTER SURFACE OF A THREE-DIMENSIONAL OBJECT

(71) Applicant: LANDA LABS (2012) LTD., Rehovot (IL)

(72) Inventor: Benzion Landa, Nes Ziona (IL)

(73) Assignee: LANDA LABS (2012) LTD., Rehovot (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/988,822

(22) Filed: Aug. 10, 2020

(65) Prior Publication Data

US 2020/0371456 A1 Nov. 26, 2020

Related U.S. Application Data

(63) Continuation of application No. 16/202,114, filed on Nov. 28, 2018, now Pat. No. 10,782,633, which is a (Continued)

(30) Foreign Application Priority Data

May 30, 2016 (GB) ..... 1609469
Aug. 9, 2016 (GB) ..... 1613713

(51) Int. Cl.
*B41J 3/407* (2006.01)
*B41M 1/40* (2006.01)
(Continued)

(52) U.S. Cl.
CPC ..... *G03G 15/1615* (2013.01); *B41J 2/01* (2013.01); *B41J 3/4073* (2013.01); *G03G 15/2014* (2013.01); *B41J 2002/012* (2013.01)

(58) Field of Classification Search
None
See application file for complete search history.

(56) References Cited

U.S. PATENT DOCUMENTS 3,587,455 A 6/1971 Childress
6,272,266 B1 8/2001 Dietz et al.
(Continued)

FOREIGN PATENT DOCUMENTS

GB 2512678 10/2014
WO 2013/132418 9/2013
WO 2017/116671 7/2017

*Primary Examiner* — Leslie J Evanisko
(74) *Attorney, Agent, or Firm* — JMB Davis Ben-David

(57) ABSTRACT

A printing apparatus and method are disclosed for printing on three-dimensional objects. The apparatus employs an offset printing process in which an ink image is deposited onto an intermediate transfer member (ITM) having the form of a flexible endless belt. After drying of the ink image on the ITM, the ITM transports the dried ink image to an impression station having a nip at which the ITM is compressed between an object and an impression surface, so that the dried ink image is transferred from the ITM to the object. The impression surface may form part of a stationary anvil, the ITM sliding relative to the impression surface during passage through the impression station. To optimize throughput, the velocity of the ITM relative to the surface of the object at the impression station may be greater than the velocity of the ITM relative to the imaging station.

20 Claims, 7 Drawing Sheets

Related U.S. Application Data continuation-in-part of application No. PCT/IB2017/053168, filed on May 30, 2017.

(51) Int. Cl.

| | |
|---|---|
| ***G03G 15/16*** | (2006.01) |
| ***B41J 2/01*** | (2006.01) |
| ***G03G 15/20*** | (2006.01) |

(56) References Cited

U.S. PATENT DOCUMENTS

| | | | | |
|---|---|---|---|---|
| 6,920,822 | B2 | 7/2005 | Finan | |
| 7,467,847 | B2 | 12/2008 | Baxter et al. | |
| 8,919,247 | B2 | 12/2014 | Morgavi et al. | |
| 9,032,872 | B2 | 5/2015 | Uptergrove | |
| 9,272,534 | B2 | 3/2016 | Domeier et al. | |
| 10,022,953 | B2 | 7/2018 | Hughes et al. | |
| 10,486,368 | B2 * | 11/2019 | Allen | B29C 65/4835 |
| 10,739,705 | B2 * | 8/2020 | Stowitts | B41M 3/12 |
| 2010/0031834 | A1 * | 2/2010 | Morgavi | B41J 3/4073 101/38.1 |
| 2016/0001546 | A1 | 1/2016 | Hughes et al. | |
| 2016/0136966 | A1 | 5/2016 | Cassoni et al. | |
| 2016/0136968 | A1 | 5/2016 | Cassoni et al. | |

* cited by examiner

Fig. 1 – Prior Art

METHOD FOR PRINTING ON THE OUTER SURFACE OF A THREE-DIMENSIONAL OBJECT

CROSS-REFERENCE TO RELATED APPLICATIONS

This is a Continuation of U.S. patent application Ser. No. 16/202,114, filed Nov. 28, 2018, which is a Continuation-In-Part (CIP) of International Application Number PCT/IB2017/053168, filed on May 30, 2017, which claims priority from Patent Application Number GB1609469.0, filed May 30, 2016, and from Patent Application Number GB1613713.5, filed Aug. 9, 2016. All of the aforementioned applications are incorporated by reference herein for all purposes as if fully set forth herein.

FIELD

The present disclosure relates to an apparatus for printing on three-dimensional (3D) objects. In particular, the apparatus is suited to printing onto the outer surface of objects having a circular cross-section, such as cans and tubes that have a generally cylindrical configuration, as well as cups that have a conical configuration.

BACKGROUND

It is commonly required to provide printed material on three-dimensional objects. While this can be achieved by adhering pre-printed labels or by shrinking pre-printed sleeves on or around the object of interest, it is often preferred to print directly onto the outer surface of the objects.

Such processes are common in the packaging industry for a variety of containers from relatively rigid canisters made of metallic or plastics materials (such as beverage cans, aerosol cans, cigar tubes, wine caps, caulking paste tubes and the like) to relatively flexible containers (such as toothpaste tubes, yoghurt cups, margarine tubs, drinking glasses and the like), as well as lids for such containers.

Metal cans are generally produced as either three-piece cans or two-piece cans. Three-piece cans are made by rolling a flat rectangular sheet of metal, usually steel, into a cylindrical tube, welding or brazing the seam, and then pressing a first cap onto one end. After being filled with the product, the second cap is then pressed onto the other end, hermetically sealing the can. Such three-piece cans are usually "decorated" (printed) in the flat, as large sheets, before being cut into smaller rectangular shapes. The advantage of decorating before forming is that conventional offset lithographic printing processes can be employed, which are little different from those used for printing on sheets of paper or paperboard, enabling high quality decoration of a large number of can bodies from a single large sheet of metal.

One reason that offset lithography is able to print with high quality is that all of the color separations comprising the full-color image (usually comprised of at least four colors inks: cyan (C), magenta (M), yellow (Y) and black (K)) are transferred in sequence to the receiving sheet in precision register with one another.

Such "process color" printing requires that certain parts of the color images, comprised of both solids and the dots which form the "half-tones" and create a very broad color range, overlap with one another to varying degrees. Therefore, each transferred ink image must be at least partially dried or cured before the next wet ink gets applied, lest the first ink be back-transferred, contaminating the subsequent color and spoiling the print quality.

The offset process works by "offsetting" an ink image from a printing plate to a receiving substrate via a conformable intermediate transfer member (ITM) called a "blanket". When the inked printing plate contacts the blanket, the ink image "wets" the blanket, splitting upon subsequent separation of the two surfaces (e.g., part of the ink of the entire ink image is transferred from the printing plate to the blanket). The wet ink image carried by the blanket is then brought into pressing contact with the receiving surface, wetting it in turn and, similarly, splitting upon subsequent separation of the two surfaces. After transfer to the receiving surface, the blanket carries the residual ink image into pressing contact with the printing plate and the process repeats. Since the blanket and the printing plate rotate in precise register with one another, the residual image simply gets "topped up" with additional ink by the printing plate, with the entire process reaching an equilibrium state.

Since the receiving substrate is two-dimensional, the printing process steps can be readily divided into separate printing stations, each followed by a drying or curing station, by simply transporting the substrate (in sheet or web format) from one station to the next without sacrificing speed or quality. This causes the distance between the first printing station and the final printing station to be very long, many times the length of an individual metal sheet, which is typically about one meter in length. Some sheet decorating presses have as many as 8 or 10 colors, typically including special colors or brand colors in addition to the primary colors, each with its own drying/curing station.

Thus, offset lithographic printing presses are usually massive precision instruments that weigh tens of tons and can produce excellent print quality on the two-dimensional metal sheets used to form three-piece cans.

Printing on the outer surface of three-dimensional objects poses entirely different challenges. Two-piece cans, aerosol cans, molded tubes, cups and similar containers are, by their nature, three-dimensional from inception. They are "formed" or molded, rather than rolled from sheet. They must therefore be decorated as three-dimensional objects. Plastic containers are generally injection molded, extruded, blow molded or otherwise thermally formed. Two-piece metal containers are usually formed or "drawn" from a blank or slug, usually of aluminum or steel, which forms the body of the can. The second piece, the cap, is also formed, usually from sheet metal. Before filling, the body is processed by degreasing and washing, after which a desired image is printed on its outer surface and a varnish may be applied to protect the print. A lacquer can also be applied to the inside of the can. The open end of the can may be "necked" or narrowed. After filling, the cap is placed on the open end and sealed relative to the body. Such bodies, whether plastic or metal, will hereinafter simply be referred to as the "cans" or "containers", intending to include all objects, such as cans and tubes that have a generally cylindrical configuration or cups that have a conical configuration, as well as objects of non-circular cross-section such as rectangular containers and formed lids.

Unlike two-dimensional sheets or webs, 3D objects do not readily lend themselves to be printed (decorated) by conventional offset printing processes, which require both precise color-to-color registration and substantial distances between numerous large printing and curing/drying stations. These challenges are so formidable that the industry has all but abandoned attempts to achieve high speed, high quality decorating directly on 3D containers by employing conventional offset printing. Those markets that demand high quality decorating have adopted labels of one type or another, whether simple paper or plastic bands, pressure sensitive labels, in-mold labels or shrink sleeves—all of which can be conventionally printed as sheets or webs. Other markets, particularly mass markets such as beverage cans and yoghurt-like cups and tubs, generally settle for lower quality direct printing by a process known as "dry offset".

Dry offset works like offset lithography, with one important difference: dry offset employs a printing plate that is letterpress-like, rather than planographic. In other words, the printing plate carries a "raised" image, which is proud of the plate surface. After being inked, the printing plate contacts the blanket surface only in the raised image areas. Consequently, a multi-colored decoration can be collected onto a single blanket from multiple printing plates "wet-on-wet"—provided that none of the colors overlap. Once all of the colors have been collected on the blanket, the entire multi-colored image can be transferred, in "one shot", to the container. By applying the entire image in a single transfer step, the container plays no role in the registration process, which involves only the precise register of the printing plates and blanket.

There are two reasons that dry offset produces inferior quality images compared to offset lithography. The first is that since no two colors are allowed to overlap, the resulting decoration is limited in color gamut to the colors of the discrete inks which are employed (typically up to ten), unlike offset lithography, which can produce many thousands of brilliant colors from only four primary colored inks. Second, in order to produce multi-colored density gradients or "half-tones", dry offset images must be produced as very fine dot patterns, in which adjacent dots are of different colors. This requires very high resolution printing plates and ultra-precise registration between different colored dot patterns, which is beyond the reach of most high speed practical mechanical equipment. Consequently, direct printing on 3D containers using dry offset continues to produce poorer quality results than conventional offset lithographic printing. In the case of printing on conical containers, the decorating quality is further degraded since, during the ink transfer step, there is a mismatch between the linear velocity of the container surface and the linear velocity of the blanket surface at the line of contact. In order to transfer the ink image from the blanket to the conical container, the two surfaces are brought into rolling contact.

In the case of cylindrical containers, the axis of rotation of the blanket-bearing drum (also referred to herein as the "impression drum") and the container cylinder are parallel to one another. Thus, upon rolling contact with the blanket mounted on the impression drum, the surface velocity of the container is uniform along the entire line of contact.

In the case of conical containers however, the diameter of the container varies along the line of contact, resulting in a higher linear velocity where the container is of larger diameter than where it is of smaller diameter. This mismatch of velocities along the line of contact during the transfer process means that parts of the image are subjected to sliding contact, possibly smearing the image in such areas. In general, only the center of the line of contact is subject to pure rolling contact, whereas the remainder of the image is subjected to sliding contact which is progressively more severe further away from the center line. Such sliding contact during transfer not only smears the image, causing inferior print quality, but it also abrades the blanket surface, shortening its useful life.

In general, containers may be transported in decorating machines to the impression station in either a step-motion, referred to as "indexed", or in continuous motion.

Most containers are thin-walled, unable to independently withstand the pressures of image transfer. Therefore, for decorating, containers are mounted on "mandrels". These are rigid metallic structures which fill the internal void volume of the container and support the container body during the transfer process.

In the case of indexed motion, the mandrels are mounted in a planetary manner around a center (i.e. axis) of rotation and indexed from one stationary position to the next. At one position the container to be decorated is slid onto the mandrel, at a second station it may be corona treated or flame treated to prepare it for printing, at the impression station it receives the ink image while at a subsequent station it may be cured, dried, overcoated, or subjected to other post-printing treatment, while at another station the container is ejected. One advantage of indexed systems is that both the blanket-bearing drum and the indexed cylinder have simple rotary motions, with the indexing cylinder bringing the containers to be decorated to a fixed stationary position for transfer of the ink image from the continuously rotating blanket-bearing drum. A further advantage of indexed systems is that the mandrel is stationary during container mounting and ejection, simplifying the loading and unloading processes.

There are, however, two main disadvantages of indexed systems. The first is handling speed. Due to the high accelerations and decelerations required to index the mandrels at high speed, as a practical matter indexed container decorating systems are limited to about 600 containers per minute. The second disadvantage is that, despite the limited throughput speeds, the printing process itself must run at a disproportionately high linear velocity. This is due to the intermittent nature of the transfer process and results in substantial non-image gaps between the printed images. Thus, only a fraction of the circumference of the continuously rotating blanket-bearing drum can participate in image transfer.

Continuous motion systems, on the other hand, have the reciprocal advantages and disadvantages compared to indexed systems. The first advantage is speed. Continuous motion container decorating systems, such as those commonly employed in the beverage can industry, can achieve very high throughput speeds, even exceeding 3,000 cans per minute. This comes at the price of complexity. For example, beverage can decorators require complicated radial position adjustment of the container path during image transfer to enable continuous rolling contact of the container's entire circumference with the blanket-bearing drum. It also requires dynamic container mounting and ejection systems able to operate synchronously with the decorator at speeds of up to 50 containers per second.

Whether indexed or continuous, a disadvantage common to all current mechanical decorating technologies for printing on 3D containers is that they all employ printing plates, which need to be physically replaced when changing the decoration pattern. Since the market is demanding ever-short run lengths, even customized and personalized packaging, the need to change printing plates and to re-adjust the press for every decoration change is becoming an increasingly important economic burden and a barrier to fulfilling market requirements.

FIG. 1 of the accompanying drawings shows an apparatus of the art for printing on the surface of beverage cans that can readily be adapted to permit printing onto the outer surface of conical objects such as beverage cups. The apparatus of FIG. 1 is only concerned with the step of printing on cans before they are filled and capped. The cans 106 follow a path 12 to the printing machine 10, being guided by a conveying system that is omitted from the drawing in the interest of clarity.

The printing apparatus has a transport drum 14 that carries around its circumference a plurality of mandrels 16, each dimensioned to fit within a respective one of the cans. Each mandrel can be mechanically rotated through gears, pulleys and the like, or may be directly driven by a motor, such as a servo motor. The effect of the gearing or servo motor, not shown, is to cause each mandrel 16 to spin about its own axis at approximately the same surface velocity as the surface of circumferentially spaced blanket pads 20 while being transported counterclockwise along a circular path by the transport drum 14. The transport drum 14 in this way brings each can sequentially to an impression station at nip 18 where it rotates and rolls against one of several circumferentially spaced blanket pads 20 that are carried on the outer surface of a counterclockwise rotating impression drum 24.

The apparatus of FIG. 1 is an embodiment of a continuous system and to enable the pads 20 to remain in contact with the cans over the entire circumference of the cans, the mandrels can move radially relative the axis of the drum 14 as they pass through the nip 18. The blanket pads 20 are ink bearing blanket pads that during rotation of the impression drum 24 pass beneath a plurality of print heads 22.

Each print head 22 is controlled to apply ink of a respective color to a respective region of each blanket pad. Ink application in such an apparatus is traditionally performed by conventional means known in the field of offset printing, for instance using plates such as employed for flexographic printing. But digitally controlled application of inks by ink jetting techniques has been reported, so that print heads 22 may encompass any such device suitable for either "mechanical printing" or "digital printing". In this way, during a cycle of rotation of the impression drum 24, a multicolor ink image is built up on each blanket pad and at nip 18 of the impression station, the blanket pad 20 makes rolling contact with one of the cans in order to print the applied multicolor ink image onto its outer surface, the different colors typically residing in different regions of the blanket pad, so as to not overlap.

Optional treatment stations 15, 17 may be provided to apply processing steps to the surfaces of the cans both before and after they pass through the nip 18. For example, in the pre-printing processing station 15, the cans may be heated, exposed to a corona discharge or have a coating applied to facilitate the transfer of the dried ink image or fixation of the dried ink image on the object following transfer. The post-printing processing station 17 may heat at least a portion of the surface of the object after transfer of the dried ink image, and/or it may cure at least a portion of the surface of the object after transferring the dried ink image, and/or a coating, to at least a portion of the surface of the object, the coating serving to facilitate fixation of the dried ink image on the object following transfer or to protect the image.

The known apparatus shown in FIG. 1 suffers from several disadvantages, namely:

The range of images that can be applied by such an apparatus is somewhat limited because areas of different color on the blanket pads cannot overlap one another, nor indeed touch one another, if an image of good quality is to be obtained.

The colors that can be applied are typically limited to standard colors, generally including only a few brand colors in addition to CMYK primary colors.

The apparatus can only be used for print runs where the identical image is printed on each object.

The apparatus can only be used for image sizes substantially matching blanket pad size.

It is necessary to replace the blanket pads between print jobs and optionally at regular intervals.

Replacement of the blanket pads is time consuming because the sizing and positioning of the new blanket pads is critical. The trailing edge of a blanket pad must separate from an object at the exact position at which the leading edge of each image comes into contact with the object. This results in a prolonged and therefore costly down time.

The above disadvantages may be mitigated by the use of a printing apparatus such as that taught by US2010/0031834, which comprises:

(i) an intermediate transfer member (ITM) having the form of a flexible endless flat belt with an inner surface and an outer release surface;

(ii) an imaging station for depositing at least one ink composition on the release surface to form an ink image;

(iii) a drying station at which the ink image is substantially dried or cured, by evaporation or by exposure to radiation, so as to form on the release surface a dried ink image;

(iv) an impression station having a nip at which the ITM is compressed between an object and an impression surface, to cause the dried ink image to be transferred from the release surface of the ITM to the outer surface of the objects; and (v) an object transport system for transporting objects to the impression station and rotating each object about its own longitudinal axis during passage through the impression station such that, at the nip, the outer surface of each object makes rolling contact with the release surface of the ITM.

In such a printing apparatus, instead of using a blanket pad, equivalent to the blanket of an offset lithographic printer, to apply a wet ink image directly onto the outer surface of the objects, an ITM of an offset inkjet printing system is used to apply a dry ink image to outer surface of the objects at the impression station. The range of images that can be applied by such an apparatus is no longer limited because areas of different color can overlap one another, thus permitting printing of images of good quality and using colors that are not limited to standard colors or specific inks. Printing of images onto the ITM under digital control is suited to shorter print runs, is not limited to any image size and dispenses with the need to replace the blanket pads.

SUMMARY

In accordance with some embodiments of the present invention, there is provided a printing apparatus for printing on an outer surface of a three-dimensional object having a longitudinal axis, the apparatus including (i) an intermediate transfer member (ITM) having the form of a flexible endless belt with a release surface, (ii) an imaging station at which at least one ink composition that comprises a coloring agent, a resin and an optional liquid carrier, is deposited on the release surface to form an ink image, (iii) a drying station at which the ink image is substantially dried, by evaporation of any liquid carrier in the ink or by exposure to radiation to cure the ink, so as to form a dried ink image on the release surface, (iv) an impression station having a nip at which the ITM is compressed between an object and an impression surface, so that the dried ink image is transferred from the release surface of the ITM to an outer surface of the object, and (v) an object transport system for transporting objects to the impression station and rotating each object about its own longitudinal axis during passage through the impression station such that, at the nip, the outer surface of each object makes rolling contact with the release surface of the ITM, wherein the impression surface forms part of a stationary anvil, the ITM sliding relative to the impression surface during passage through the impression station.

Further provided, in accordance with some embodiments of the present invention, is a method of retrofitting a three-dimensional object printing system, the method including providing a three-dimensional object printing system, the object printing system including a plurality of first print heads, installing a sub-assembly, the sub-assembly including an intermediate transfer member (ITM) having the form of a flexible endless belt with a release surface, an imaging station at which at least one ink composition that comprises a coloring agent, a resin and an optional liquid carrier, is deposited on the release surface to form an ink image, the imaging station including a plurality of second print heads, and a drying station at which the ink image is substantially dried, by evaporation of any liquid carrier in the ink or by exposure to radiation to cure the ink, so as to form a dried ink image on the release surface, and adapting the system to the sub-assembly, including retaining the plurality of first print heads separate from the imaging station or removing the plurality of first print heads, wherein the adapted system includes an impression station having a nip at which the ITM is compressed between an object having a longitudinal axis and an impression surface, so that the dried ink image is transferred from the release surface of the ITM to an outer surface of the object, and wherein each object rotates about its own longitudinal axis during passage through the impression station such that, at the nip, the outer surface of each object makes rolling contact with the release surface of the ITM, and wherein the impression surface forms part of a stationary anvil, the ITM sliding relative to the impression surface during passage through the impression station.

Further provided, in accordance with some embodiments of the present invention, is a method of printing on an outer surface of a three-dimensional object having a longitudinal axis, the method including depositing on a release surface of an intermediate transfer member (ITM) having the form of a flexible endless belt at least one ink composition that comprises a coloring agent, a resin and an optional liquid carrier to form an ink image, substantially drying the ink image, by evaporation of any liquid carrier in the ink or by exposure to radiation to at least partially cure the ink, so as to form a dried ink image on the release surface, and compressing, at a nip of an impression station, the ITM between an object and an impression surface, so that the dried image is transferred from the release surface of the ITM to an outer surface of the object, wherein the object rotates about its own longitudinal axis during passage through the impression station such that, at the nip, the outer surface of the object makes rolling contact with the release surface of the ITM, and wherein the impression surface forms part of a stationary anvil, the ITM sliding relative to the impression surface during passage through the impression station.

Further provided in accordance with some embodiments of the present invention are printing apparatuses and methods, and methods of retrofitting which include fewer, more and/or different features than described above. For example, certain apparatuses and methods may have an impression surface which forms part of a rotatable impression cylinder or drum instead of an impression surface forming part of a stationary anvil.

The terms anvil, stationary anvil, impression anvil, and variants thereof are used interchangeably herein for an article which is stationary, wherein an impression surface forms part of the article.

BRIEF DESCRIPTION OF THE DRAWINGS

Embodiments of the disclosure will now be described, by way of example, with reference to the accompanying drawings, in which.

DETAILED DESCRIPTION

The ensuing description, together with the figures, makes apparent to a person having ordinary skill in the pertinent art how the teachings of the disclosure may be practiced, by way of non-limiting examples. The figures are for the purpose of illustrative discussion and no attempt is made to show structural details of an embodiment in more detail than is necessary for a fundamental understanding of the disclosure. For the sake of clarity and simplicity, some objects depicted in the figures may not be drawn to scale.

The principle of operation of an offset inkjet printing system allowing the transfer of substantially dry ink images will be described below to the extent necessary for an understanding of the present invention but the interest reader is also referred to PCT publication WO2013/132418 which describes such a system in detail and is incorporated herein by reference.

In the present disclosure, instead of using a blanket pad, equivalent to the blanket of an offset lithographic printer, to apply a wet ink image directly onto the outer surface of the objects, an ITM of an offset inkjet printing system is used to apply a dry ink image to the outer surface of the objects at the impression station.

The ink image is said to be dry or substantially dry if any residual amounts of liquid, or of any volatile compound, do not adversely affect the transfer process from the ITM to the object, nor the printing quality on its surface. In practice, the percentage of any residual liquid solvent or carrier may typically be less than 5 wt. %, 4 wt. %, 3 wt. %, 2 wt. %, or even 1 wt. %.

Overall Description of the Printing System

Figure 1:
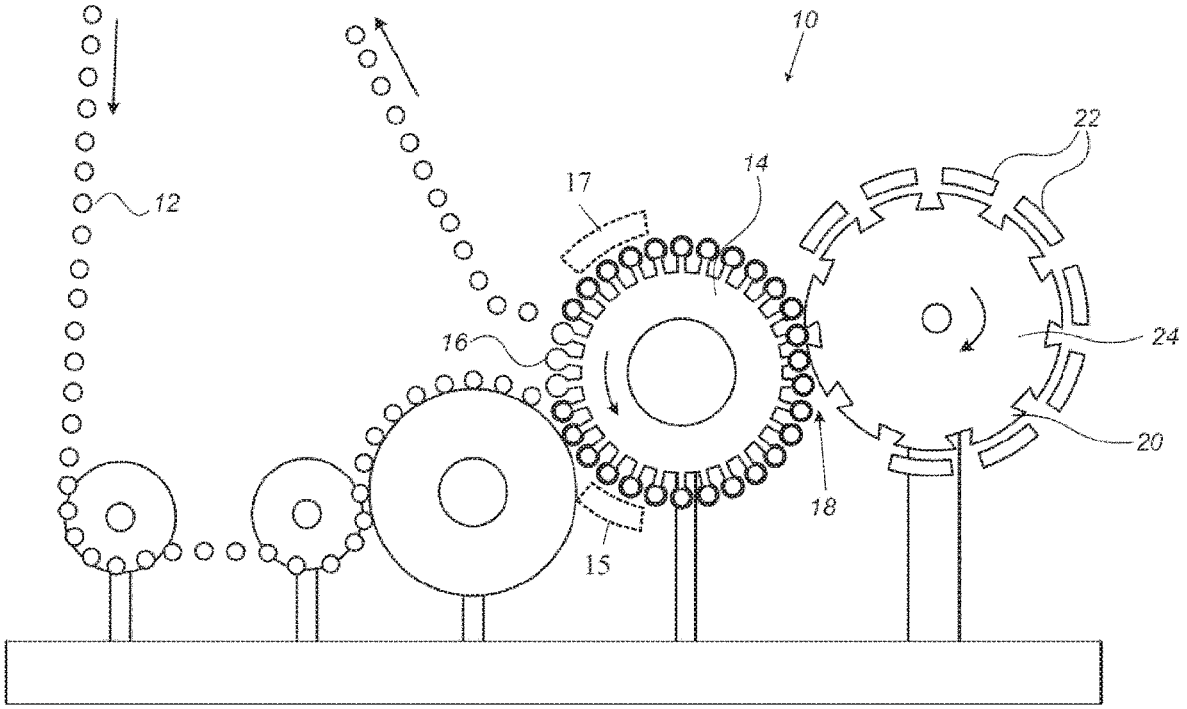
FIG. 1, as described above, shows schematically a known apparatus for printing on the outer surface of cans.
Figure 2:
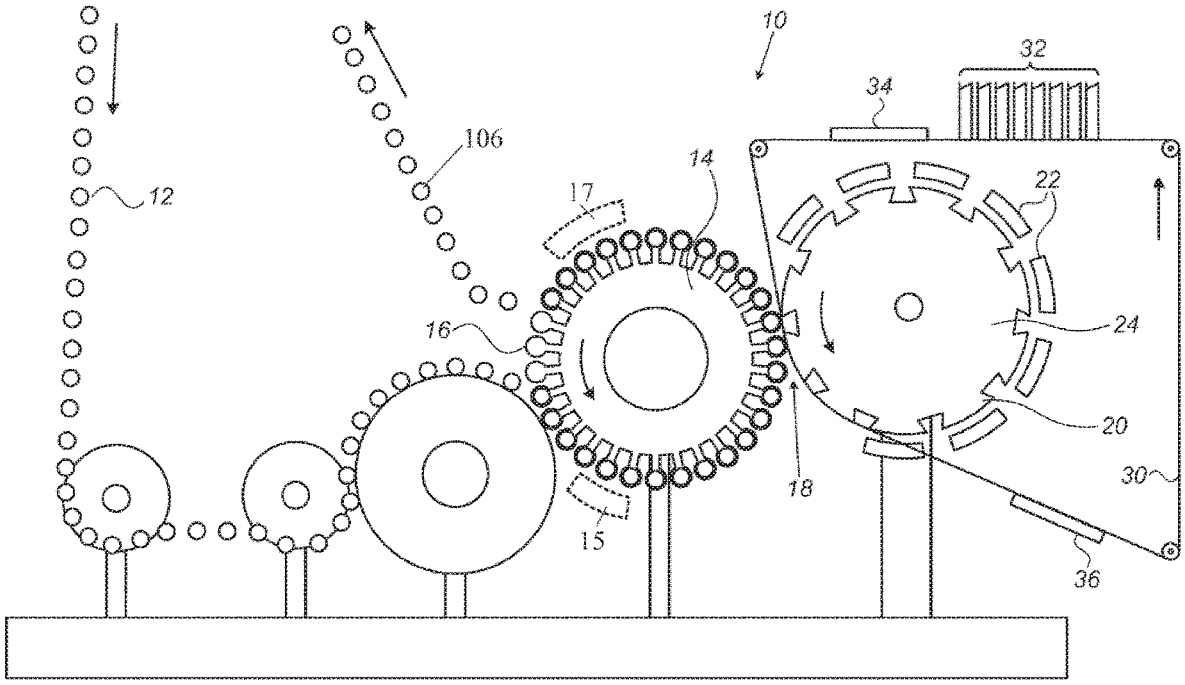
FIG. 2 is a similar view to FIG. 1 showing a first embodiment of the teachings of the present disclosure.

Referring first to FIG. 2, it will be seen that the apparatus of the present disclosure, in one embodiment, retains all the components of the known apparatus shown in FIG. 1. In addition, the apparatus comprises a digital offset inkjet printing system that comprises an imaging station 32, a drying station 34, and an optional cleaning and/or conditioning station 36. An ITM 30 in the form of an endless belt is independently driven and passes through the various stations 32, 34 and 36 and also through the nip 18 between the cans 106 on the mandrels 16 and the compressible blanket pads 20 on the impression surface of impression drum 24. In this embodiment, however, no ink is applied to the pads 20 which serve only to ensure that the ITM 30 should conform to the outer surface of the respective can.

The offset inkjet printing system starts a cycle by jetting an image onto the ITM 30. The ink is dried in the drying station 34 to leave a dry ink image in the form of a substantially dry residue of colored resin. When the ITM 30 is next pressed by a compressible blanket pad 20 against the outer surface of a can 106 in the impression station at nip 18, the dry ink image transfers to the can and separates cleanly from the ITM 30. The ITM 30 is then optionally cleaned and/or conditioned in the station 36 before it is returned to the imaging station 32 to commence a new cycle. In each such cycle of the ITM, printing is generally performed on a plurality of 3D objects, the number of which may depend on the length of the ITM and the surface to be printed on each individual object.

Any form of offset inkjet printing system may be used in the present disclosure but it is preferred to adopt the teachings of WO2013/132418. In this earlier proposal, the inks use an aqueous carrier (e.g., containing at least 50 wt. % of water) rather than one containing an organic solvent and the ITM has a hydrophobic release surface. The water-based ink is more environmentally friendly and the hydrophobic release surface assists in the separation of the dried ink image from the ITM and its transfer to the object without splitting.

In order to avoid unnecessarily extending the present description, parts of the offset inkjet printing system common to WO2013/132418 will be described herein only in sufficient details to understand the present disclosure. The interested reader is referred to the latter specification for further details. This applies to the imaging station 32, the drying station 34, the construction of the ITM 30, the compositions of the inks and the release surface of the ITM 30, the transport system used for guiding, driving, threading and tensioning the ITM 30, further described in additional applications to which the PCT publication refers.

The ITM can have two zip fastener halves secured to its respective side edges and their teeth can be retained in C-shaped guide channels to maintain the ITM in lateral tension and guide it through the various stations. The ITM 30 can be independently driven by motors acting on rollers over which the ITM 30 is guided, the rollers also serving to maintain the ITM 30 in tension in the direction of travel. During its operating cycle, the ITM 30 can be heated in some locations, such as during its passage through the drying station, and can be cooled in others, such as at the optional cleaning and/or conditioning station 36 so that there is a temperature profile along its length, but its temperature stabilizes after a period of operation.

The temperature desired at each station and the resulting profile may vary depending on the type of the ITM and the inks being used. For instance, the temperature on the release surface of the ITM at the image forming station can be in a range between 40° C. and 90° C., or between 60° C. and 80° C. for water-based or solvent- based inks, the solvents having a boiling point of less than 100° C. In some embodiments, the drying is achieved by evaporation of the ink liquid carrier by application of elevated temperature at the drying station, the drying temperature being in a range between 90° C. and 300° C., or between 150° C. and 250° C., or between 175° C. and 225° C. In some embodiments, the temperature at the impression station is in a range between 80° C. and 220° C., or between 100° C. and 160° C., or at any temperature allowing the dried image to be sufficiently tacky to transfer to the surface of the object. If cooling is desired to allow the ITM to enter the imaging station at a temperature that would be compatible to the operative range of such station, the cooling temperature may be accordingly in a range between 40° C. and 90° C. Such cooling effect can be achieved by the application of a dedicated cooling fluid to the surface of the ITM or may result from the application of a conditioning liquid, which can optionally be cooled to temperatures below ambient temperature (e.g., below about 23° C.).

If the inks being used rely on energy curable polymers (including their constituting monomers, oligomers and any other like pre-polymer), the profile and temperature at each station may be adapted accordingly. If the curable polymers are dispersed or dissolved in a liquid carrier in amounts similar to non-curable resins, the temperature profile may be similar to above-described at the imaging station and at the drying station, where the liquid is being substantially eliminated. In such a case, the drying of the ink image also includes at least partial curing of the curable inks applied at the imaging station. If, on the other hand, the curable polymers together with the relevant coloring agent(s) and any suitable ink additive (e.g., photoinitiator(s) for UV-light curable materials) constitute most of the curable ink, then the elimination of a liquid carrier may become superfluous, allowing to lower the operating temperatures. In a particular case of curable inks substantially devoid of liquid carrier, the printing process may optionally be carried out at or near ambient temperature. In such a case, the drying of the ink image is predominantly achieved by curing of the ink(s), rather than by thermal drying. The type of suitable curing depends on the nature of the curable polymer (e.g., UV- or EB- (Ultra-violet light or Electron Beam respectively) curable). As used herein, the term "drying" includes thermal drying, energy curing and their combination, as applicable to substantially dry an ink image before its transfer to the surface of a three-dimensional object.

The ITM may be required to have several specific physical properties that may be achieved by having a complex multi-layer structure, the part excluding the release surface being generally termed the body of the ITM. The ITM may, for instance, be flexible enough to follow the contour of the impression surface bearing the optional compressible blanket pad and of the object applied thereupon at the nip of the impression station. Generally, the body of the ITM includes a highly compliant thin layer immediately beneath the release surface (e.g., an hydrophobic surface) to enable the dried ink film to follow closely the surface contour and topography of the object at the impression station. This layer is generally termed a conformational layer.

In some embodiments, a compressible member may enhance the contact between the dry ink image carried by the release surface of the ITM and the surface of three-dimensional object. This can be achieved by compressible blanket pads positioned on the impression surface of the rotatable impression cylinder or drum, or of the anvil. Alternatively, or additionally, a compressible member can be achieved by including a compressible layer within the ITM, the compressible layer being optionally an underlying layer distinct from the release surface. For example, in printing systems wherein the impression surface of the rotatable impression cylinder or drum, or of the impression anvil lacks a compressible blanket pad positioned thereupon, the body of the ITM may include a compressible layer suitable to achieve satisfactory contact between the dried ink image on the release surface and the object. The presence of such a compressible layer in the ITM may also be desired when compressible blanket pads exist on the impression surface, the release surface being then "sandwiched" by two compressible members at the impression nip.

In some embodiments, for particular types of objects, compressible blanket pads, and generally said type of impression stations, the body of the ITM includes a support layer which can be reinforced, for instance with a fabric, so as to be substantially non-extendible (at least in the direction of movement of the ITM). However, in other embodiments, for instance, for non-cylindrical objects, the support layer may permit the ITM to stretch elastically in the direction of movement of the ITM. The support layer may additionally provide sufficient mechanical stability so as to avoid undesired deformation of an image during transport to an impression station and/or transfer to an object.

It is understood that an image to be transferred to the outer surface of an object may need to be applied to the ITM in an accordingly distorted manner so as to provide for the desired printed pattern following transfer (e.g., of the dried ink(s)). Hence "undesired deformation" refers to any modification in the structure of the ITM that can affect the transfer of the dry ink image in a manner deviating from the desired pattern to a noticeable extent. As readily appreciated, the ITM and its body may include other layers to achieve the various desired frictional, thermal, and electrical properties of the ITM, as may be preferred to better suit any particular operating conditions of the printing system. By way of non-limiting example, an ITM intended for the transport of an ink image to be dried by thermal heating can be heat resistant at least up to the temperatures envisioned for such drying; an ITM intended for the transport of an ink image to be cured by energy curing can be resistant to the energy sources at least up to the energy levels envisioned for such curing; and more generally the ITM, ink compositions, conditioning, treating and/or cleaning solutions may be compatible and/or chemically inert with one another, and any such considerations known to the skilled person.

Advantageously, the impression station allows for intimate contact at the nip 18 between the dry ink image and the outer surface of the object to which it may transfer. Preferably, no air pockets can build up as the object rotates against the ITM, providing for a transfer of substantially the entire dry image, without discontinuities that may have resulted from inadequate contact.

The imaging station 32 comprises several individual print bars each comprising a plurality of print heads, each of which has a nozzle plate with a plurality of jetting nozzle arranged in a parallelogram shaped array. Each print bar typically prints a different color and the temperature of the ITM ensures that the droplets of each color are dry to some extent before the ITM reaches the subsequent print bar of a different color. Air blowers may be used to help dry the ink droplets and more importantly to prevent condensation of water on the nozzle plates.

The drying station 34 can use air blowers, radiant heaters or heater plates beneath the ITM 30 when relying on thermal elimination of a liquid ink carrier. There can also be several heating sections operating at different rates, to bring the dried ink residue at a controlled rate up to the desired temperature at which it will best transfer to the cans in the impression station at nip 18. Alternatively, and additionally, the drying station 34 can include UV-lights or an electron beam device, as appropriate to at least partially cure the inks being used. Satisfactory curing is achieved when the dried/cured image is sufficiently dried not to split during transfer, while retaining enough tackiness to transfer.

When the ink is water based, ink droplets tend to bead up in the imaging station when jetted onto a hydrophobic release surface of the ITM 30. With a view to mitigating this problem, in particular for inks including non-curable resins, the cleaning and/or conditioning station 36 can apply a very thin conditioning layer (e.g., forming a cohesive hydrophilic surface or having charges opposite to the ink) to the entire release surface of the ITM 30. The station 36 can use a doctor blade having a rounded tip of small radius of curvature, e.g. of the order of 1 mm, to apply a thin layer of conditioning or treatment solution to the ITM 30. At the elevated temperature of the ITM 30 at this point, generally at least above 90° C., the liquid layer, which has a thickness of only a few microns, dries within a few milliseconds to leave behind a thin dry film. The aqueous ink droplets wet this dry surface on impact and rather than bead up they tend to at least retain the pancake shape generated upon impact, though some increase in diameter beyond their maximum diameter resulting from their impact may occur on selection of suitable treating solutions. After it has dried, this conditioning film is transferred to the outer surface of the can at least within the image area (where they bond to the ink droplets) and optionally additionally within surrounding non-image areas, in the event the dried conditioning film has sufficient cohesivity. On returning to the cleaning and/or conditioning station 36, a liquid (which may be water or the same treatment solution) can be used to dissolve any of the film remaining from the preceding cycle before a fresh conditioning film is applied.

Alternatively, the ink employed in accordance with the invention may be UV- or EB-curable. Such ink may be employed as an emulsion, such as a water-borne emulsion, or as a solution, such as a solvent-borne solution, or may be entirely water- or solvent-free. It may be desirable to partially cure the ink before transfer to the final substrate, rendering it tacky in order to effect transfer, optionally followed by a final cure after transfer to the container (e.g., to improve fixation of the transferred image).

The cans may be subjected to processing before and/or after they pass through the nip 18 of the impression station. Such processing may be performed while the cans are on the mandrels 16 of the transport drum 14 or on the path 12. Path 12 may include, for example, any appropriate transport mechanism such as a production conveyer, chute and/or guide. Transport drum 14, separately or in combination with any other appropriate transport mechanism, is an example of an object transport system for transporting objects to the impression station and rotating each object about its own longitudinal axis during passage through the impression station.

Pre-processing (or pre-printing processing, which may take place, by way of example, at a pre-printing or pre-processing station 15) may entail heating the cans and/or treating them chemically or by corona or by plasma or by flame to facilitate the transfer and secure bonding of the dried or partially cured ink images from the ITM 30 to the cans. At least a portion of the outer surface of the cans may be heated, exposed to a corona discharge or have a coating applied to facilitate the transfer of the dried ink image or fixation of the dried ink image on the object at such stations.

Processing after passage through the impression station (or post-printing processing, which may take place, by way of example, at a post-printing or post-processing station 17) may involve heating to dry the inks more thoroughly, or possibly to cure the inks in some cases, and applying a protective coating, for example of varnish, to at least a portion of the surface of the object after transfer of the dried ink image, and/or curing at least a portion of the surface of the object after transferring the dried ink image, and/or applying a coating to at least a portion of the surface of the object, the coating serving to facilitate fixation of the dried ink image on the object following transfer or to protect the image.

The compressible blanket pads 20, in addition to having compressibility suitable for sufficiently urging the release layer to the outer surface of the objects, may be shaped in accordance with the shape of the object to be contacted. Taking for example a generally cylindrical object having a circular or ellipsoidal cross section, the blanket pad may be a curved plane having an angle of curvature corresponding to the shape and dimension of the object to be printed upon. The shapes and dimensions of a compressible blanket pad enabling rolling contact with the desired area of the object outer surface can readily be appreciated by persons skilled in the art.

Figure 3:
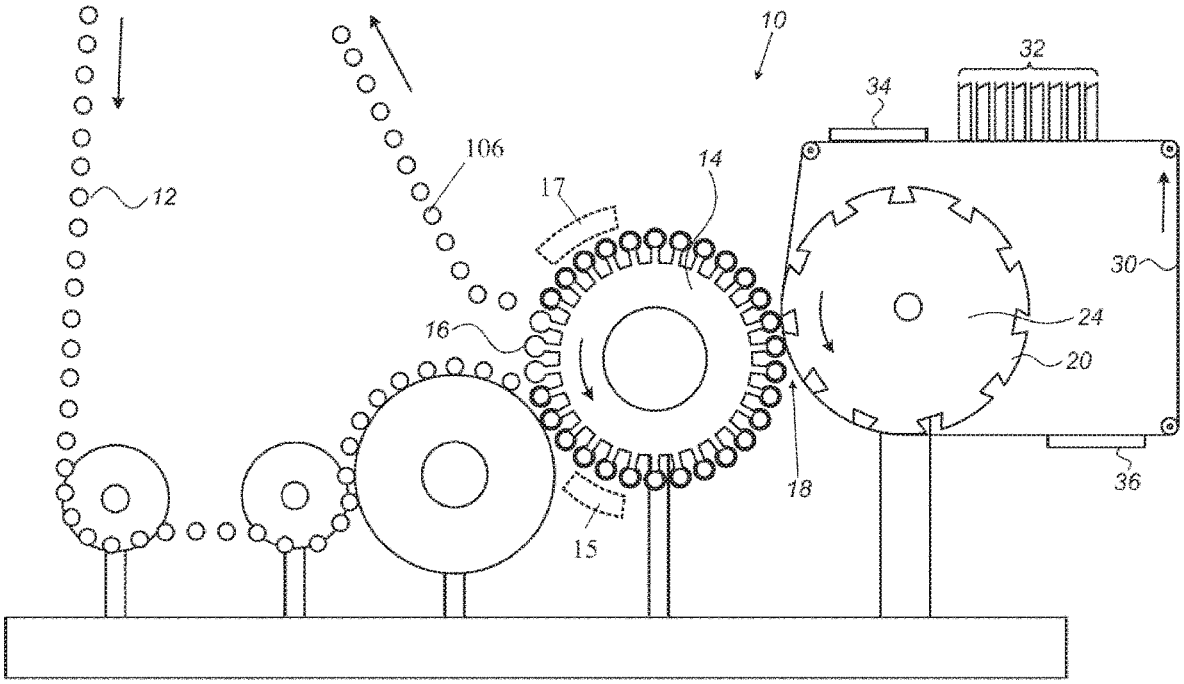
FIG. 3 is a similar view to FIGS. 1 and 2 showing a second embodiment.

It should be mentioned in this context that the nip, i.e. the point where the ITM is squeezed between a blanket pad and one of the objects, is not stationary in the case of the transport systems described in FIGS. 1, 2 and 3, because the axis of each mandrel moves at the same time as it spins while making rolling contact with the ITM 30. Contact between the cans and the ITM is maintained during this transfer step since each mandrel can also move radially such that the trajectory of the can's outer surface at the line of contact conforms to the outer diameter of the blanket-bearing drum 24. Of course, such radial motion of the mandrels is not required in the case of an indexed system, which holds each mandrel axis stationary at the impression station until the entire circumference of the container has been decorated. Although drums and cylinders which are typically rotatable (e.g., impression drum 24 or impression cylinder 56) are shown in FIGS. 2 to 5, an impression anvil may be used instead, as will be discussed in more detail below with reference to FIGS. 6 to 8. If the impression drum 24 illustrated in FIGS. 2 and 3 is instead stationary, and the ITM 30, for example, is driven by at least one distinct driving cylinder along its path, then the impression drum 24 may itself be transformed into a stationary anvil, and the surface of the immobile drum which at the nip 18 of impression station faces the object may be used as the impression surface.

The description of the various stations given above applies to the embodiments of both FIG. 2 and FIG. 3. The only difference being that in FIG. 3, the redundant print heads 22 of the conventional equipment, which are not comprised in the imaging station 32, are removed, whereas in FIG. 2 the redundant print heads 22 are retained separate from the imaging station 32. Print heads 22 are also referred to herein as first print heads. As already mentioned, the first print heads of 3D object printing systems which may benefit from retrofitting according to the present teachings include all conventional devices readily appreciated by the skilled person as being suitable for either "mechanical printing", such as print plates of lithographic printing or print screens of silk printing, or for "digital printing", such as inkjet print heads. Digital printing print heads may also serve as "second" print heads in an imaging station 32.

It is an advantage of the system of FIG. 2 that it may be retrofitted to an existing conventional apparatus with minimal interruption to the production line. The digital offset inkjet printing system according to the present teachings may be formed as a sub-assembly and positioned around the existing impression drum 24 while the production line continues to operate conventionally. Production need only be stopped for long enough to thread the ITM 30 through the nip 18 of the impression station.

Figure 4:
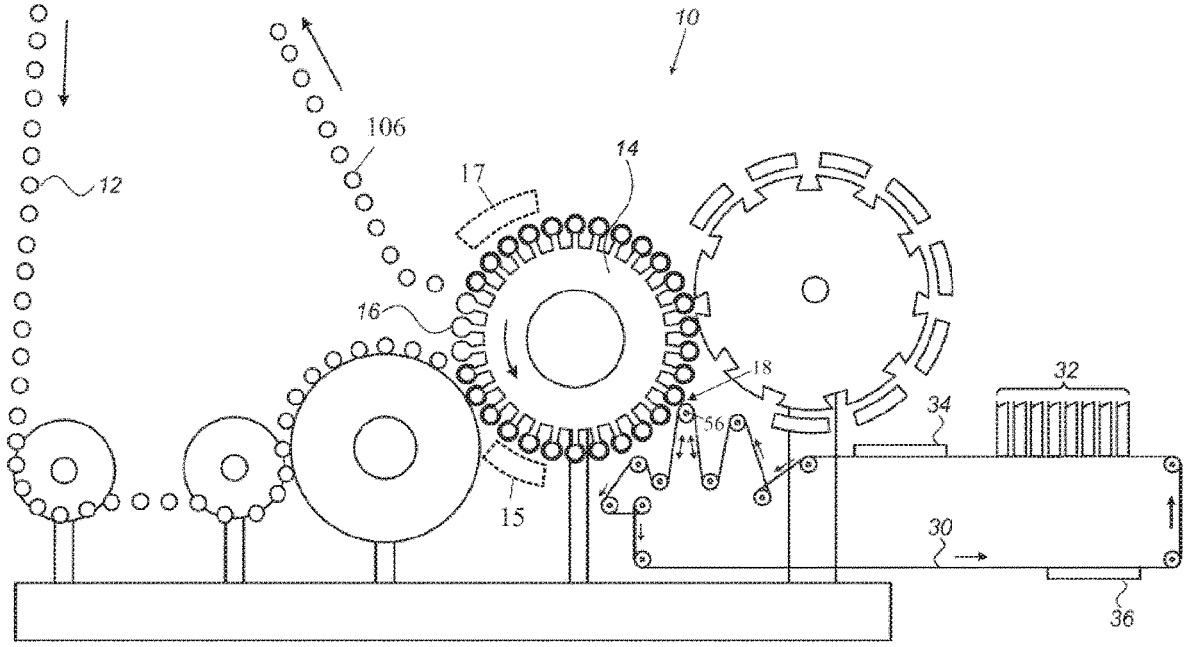
FIG. 4 shows a third embodiment of the teachings of the present disclosure.

An alternative retrofit configuration is shown in FIG. 4, in which an impression cylinder 56 (or an impression anvil- not shown) is mounted between the existing blanket-bearing drum 24 and existing container handling system. The print heads 22 of the conventional equipment, which are not comprised in imaging station 32, are retained separate from the imaging station 32. The advantage of such a configuration is that decorating can be simply switched between, for example, mechanical printing of a pre-existing system and digital printing of a sub-assembly enabled by embodiments of the present invention.

However, in some embodiments of the printing apparatus of the present disclosure, the printing apparatus does not represent a retrofit of a conventional apparatus, but is instead implemented independently. In such embodiments, the printing apparatus may be implemented without a rotatable blanket-bearing drum 24 and/or without the print-heads 22 that are not comprised in imaging station 32, unless the printing apparatus will be switching between different types of printing.

With a view to increasing the efficiency, in some embodiments of the printing apparatus, the velocity of the ITM 30 relative to the surface of the object at the impression station may be greater than the velocity of the ITM 30 relative to the imaging station 32. Such embodiments take advantage of the fact that it is possible for the speed of image transfer at the impression station to be higher than the speed of movement of the ITM 30 at the imaging station 32, where its speed is limited by the ability of the imaging station 32 to deposit an ink image of acceptable quality onto the ITM 30. In such embodiments, the ITM moves at substantially constant velocity past the imaging station 32.

In some embodiments where the velocity of the ITM 30 relative to the surface of the object at the impression station is greater than the velocity of the ITM 30 relative to the imaging station 32, which may be suited to continuous object transport systems, the desired speed difference may be achieved by moving the object in the opposite direction to the movement of the ITM at the impression station, while maintaining the velocity of movement of the ITM uniform over its entire length. In this case, the nip at which image transfer occurs is not stationary, thereby allowing the image transfer rate to exceed the image deposition rate. In such embodiments, throughput is increased by making optimum use of the ITM. Ink images may be deposited over its entire surface, with only a minimal gap between consecutive images, because while printing the trailing edge of an image onto one object, the leading edge of a succeeding image will be moving into position for transfer onto the next object.

In alternative embodiments where the velocity of the ITM 30 relative to the surface of the object at the impression station is greater than the velocity of the ITM 30 relative to the imaging station 32, which may be suited to indexed object transport systems, the nip between the ITM and the objects may remain stationary, and the section of the ITM at the nip 18 may be accelerated while printing on an object and decelerated, or possibly having its direction reversed, between objects, buffers being provided on opposite sides to the nip 18, and/or between the imaging station 32 and the impression station, to tack up the resulting slack in the ITM and maintain the ITM under constant tension. In such embodiments, throughput is once again increased by making optimum use of the ITM and enabling ink images to be deposited over its entire surface, with only a minimal gap between consecutive images. The ITM surface is in this case accelerated during image transfer onto an object to permit a higher transfer rate, but it is temporarily slowed down, paused, or even reversed, to position the leading edge of the next image correctly for transfer to the next object. Such acceleration and deceleration will occur several times during one complete cycle of the ITM through the imaging station. If the ITM is seamed, it is possible to vary the speed of the ITM additionally as it passes through the impression station, but not while printing on an object, in order to avoid printing on an object during passage of the seam through the nip.

Figure 5:
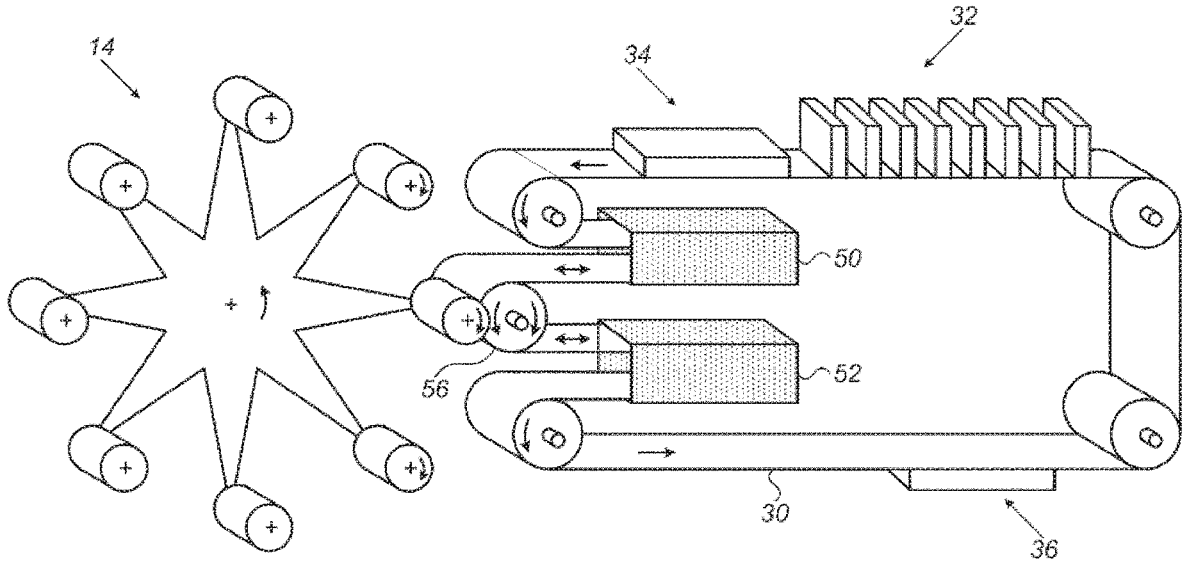
FIG. 5 shows a fourth embodiment of the teachings of the present disclosure.

Referring more specifically to FIGS. 4 and 5, the ITM moves at substantially constant velocity past the imaging station 32, but may move in an intermittent or even reciprocating manner at the impression station at nip 18. Such intermittent or reciprocating motion, which requires buffers or dancers to accommodate velocity differences between the velocity of the ITM at the impression station and its velocity at the imaging station, may be achieved by various methods, some of which are known in the art. A "reciprocating mechanism" wherein the velocity (speed and/or direction) of the ITM may differ at the imaging and impression stations is schematically illustrated in FIG. 4 by the pair of up down arrows adjacent to the impression nip 18.

One method for generating such alternating motion, employs a combination of a variable velocity low mass impression cylinder driven by a servo motor and vacuum-tensioned buffer chambers 50, 52 as shown in FIG. 5. The aim of such an intermittent or reciprocating motion of the ITM is to enable the transfer of images to the containers at the required high linear velocity while slowing down or reversing the ITM motion at the impression station during the inter-image spaces. The remarkable characteristic of such a system is that the ITM velocity during transfer can be higher than the ITM velocity during image formation.

While no can is engaged with impression roller or cylinder 56 in FIG. 5 (or alternatively when no can is engaged with an impression anvil or a rotatable impression drum- not shown in FIG. 5), no movement of the ITM 30 occurs at the nip and a length of ITM 30 carrying an image is stored within the buffer chamber 50, in which a roller within the chamber is moved to the right as viewed by the action of a vacuum acting on the movable roller and the ITM 30. At the same time, a roller in the buffer chamber 52 moves to the left as viewed, against the action of vacuum in the chamber 52 to release a length of the ITM 30 stored in the buffer chamber during printing on the surface of a can. Conversely, when a can is engaged at the nip, the speed of the ITM 30 at the nip is greater than its speed through the image printing station 32 and the difference is made up by emptying the buffer chamber 50 upstream of the nip and storing the surplus length of the ITM 30 in the buffer chamber 52 downstream of the nip. Since the blank spaces between images on the ITM can be substantially eliminated, the images can be formed adjacent one another, enabling a lower process speed at the imaging station while still maintaining high linear velocity at the impression station.

As may be seen from the figures (and best shown in FIG. 8 detailed below), the nip allows one line of contact at a time between a container and the ITM surface. In the case of indexed container motion, it is desirable to have a stationary line of contact between the round container and the ITM surface. It is therefore convenient to employ a fixed rotatable impression cylinder or drum to support the ITM during transfer. In the case of the present disclosure, a fixed rotatable impression cylinder or drum may be of large diameter, such as impression drums presently used in container decorators, and may by continuous or segmented, or it may be of very small diameter, even smaller in diameter than the containers themselves.

In the case of continuous container motion of round containers, the line of contact during transfer is not fixed, so when an impression cylinder or drum is used, the line of contact must follow the arcuate path of the impression cylinder or drum, as in the case of beverage can printers described above. In the case of rectangular containers, these are generally printed one side at a time, requiring the side to be printed to be slightly deformed to conform to the planetary radius of the mandrels, in order to ensure continuous line contact with the impression cylinder or drum during transfer.

The present disclosure can be readily employed in each of the aforementioned configurations. In each case the ITM may be a membrane without a compressible layer—in which case the compressible layer is provided by blanket pads or a compressible layer or blanket on the impression cylinder or drum—or it may be a compound component comprised of both a suitable release layer and a compressible layer. In the latter case, the impression cylinder or drum may be bare metal, as the compression function is performed by the ITM itself.

Figure 6:
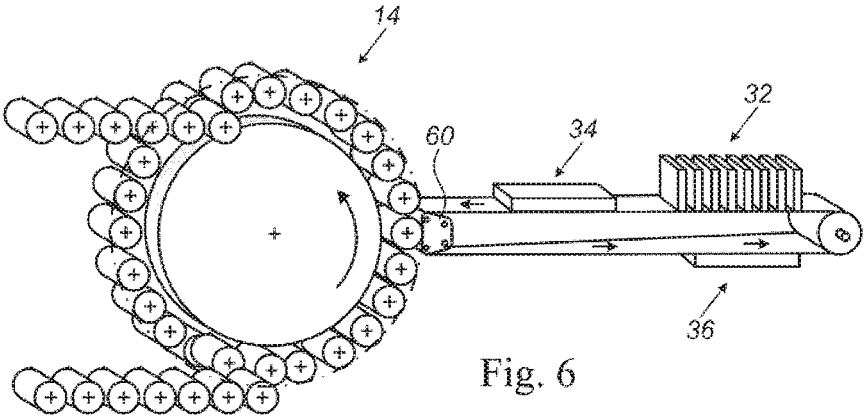
FIG. 6 shows a fifth embodiment of the teachings of the present disclosure.
Figure 7:
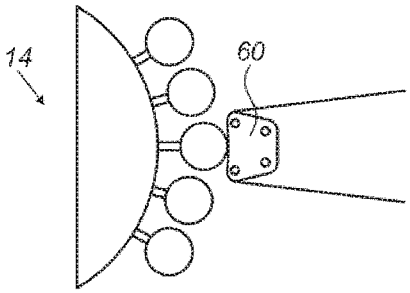
FIG. 7 shows an enlarged view of a section of FIG. 6.
Figure 8:
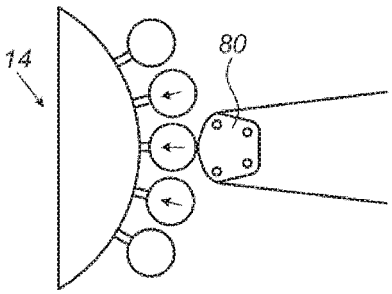
FIG. 8 is a similar view to that of FIG. 7 of an alternative embodiment in which the surface of the anvil is convex and the mandrels are capable of radial movement.

Since embodiments of the present disclosure employ a continuous conveyor as an ITM, additional advantageous configurations are possible. For example, in the case of continuous container motion, a rotatable impression cylinder or drum can be replaced by a concave "shoe" or "impression anvil" 60 as shown in FIG. 6 and to an enlarged scale in FIG. 7. In the case of an impression anvil, the ITM must slide over the anvil during the transfer process, which requires the ITM-anvil interface to be of low friction or be well lubricated. In the case of containers which are rotated in a purely circular path, the radius of the anvil's concave segment should conform to the path of the outer contact line of the containers to be decorated, to ensure uniform contact during the entire transfer step. However, in the case of adapting an existing container handling system, in which the cans are moved radially to accommodate the path of the conventional blanket-bearing drum, the impression anvil 80 replacing the conventional blanket-bearing drum should have a convex contour, as shown in FIG. 8, similar in radius to the radius of the conventional blanket-bearing drum for which the can conveyor system was originally designed. Alternatively, a convex impression anvil can conceivably be formed by immobilizing the rotatable impression drum, as long as driving cylinders are placed along the path of the ITM for moving the ITM. As above exemplified, the impression surface forming part of impression anvil 60 or 80 may be concave or convex, respectively, in the direction facing the can currently at the nip 18 of the impression station.

In some embodiments of the present disclosure, the impression surface of an impression cylinder or anvil may have a length, measured in the direction of movement of the ITM, that is shorter than the circumference of the object. Alternatively, the impression surface may have a length, measured in the direction of movement of the ITM, that is substantially equal to the circumference of the object.

The present invention may replace the conventional printing process and impression drum used for printing on lids. In the case of lids, it is desirable that the ITM have a greater degree of elasticity than for printing cylindrical objects, in order to enable the impression blanket pad to stretch the ITM into conformation with the lid surface adjacent to the lid lip. In particular embodiments, the impression surface supporting the ITM during its contact with the lid may be adapted to avoid contact with the edges of the lid, which contact may over time be deleterious to the integrity of the ITM and/or to its desired functionality.

Decorating conical containers requires special considerations. As previously described, in order to avoid smearing or any other deformation of the image upon transfer to conical containers, as well as to avoid premature abrasion of conventional blanket surfaces during transfer, it is desirable for the surface of the container and the surface of the blanket to move at the same linear velocity across the line of contact. However, since the linear velocity on the surface of a conical container rotating on its axis varies with the radius of the container, the linear velocity of the blanket surface must similarly have a varying velocity across the line of contact with the container. Such a matching of velocities would be hypothetically possible by employing a conical blanket-bearing drum of matching shape to the container. In practice, however, no such systems exist since the blanket drums of multi-color dry offset presses must be of very large diameter, making it impossible to produce a conical blanket-bearing drum which has an outer surface as narrow as a container while matching the diameter ratios of a small container.

Figure 9:
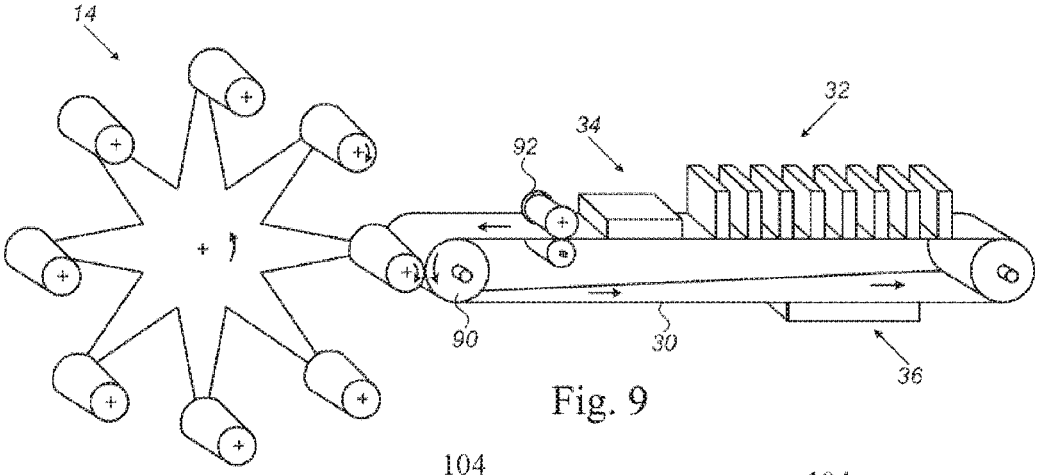
FIG. 9 shows a still further embodiment intended for printing on the outer surface of conical objects.

In the embodiments of the present disclosure, it is possible to overcome this shortcoming by making the ITM highly elastic and allowing it to stretch as it enters the transfer zone and shrink after leaving the transfer zone. Such stretching can take place, for example in the case of indexed containers, over an impression cylinder which may be conical, such as conical impression cylinder 90 shown in FIG. 9, or over an impression cylinder which may be a cylindrical impression cylinder, or over a rotatable impression drum. The stretching can alternatively take place over a specially shaped anvil, for example in the case of continuously moving containers. Additionally or alternatively, in the case where the ITM-container interface has very high friction, the container itself may be employed to stretch the elastic ITM in order to match the respective linear velocities. In such case, friction between the ITM and the rotatable impression cylinder or drum, or between the ITM and the anvil must be low to enable the ITM to freely slide over the impression surface. In any of the above configurations, the impression surface and the axis of rotation of a conical object during passage through the impression station are inclined relative to one another in order to accommodate the slant of the outer surface of the conical objects.

In any of the above configurations it may be desirable to limit the stretching of the ITM to the vicinity of the transfer zone by nipping the ITM between a pair of stretch resistance rollers 92 which lock the ITM linear motion by gripping both edges of the ITM outside the image area, ensuring that they have the same linear velocity, thus ensuring minimal stretching outside of the vicinity of the transfer zone, enabling consistent and repeatable imaging Of course, in the case of a non-cylindrical object such as a conical object, the digital image may be distorted, e.g., may be a distorted mirror image of the ultimate printed image, to inversely compensate for the stretching of the ITM in the transfer zone to ensure that the ultimate printed image has the desired undistorted proportions.

As an alternative to stretch resistance rollers 92, in embodiments where the teeth of zip fasteners engaged in lateral guides are used to constrain the path of the ITM, one or both of the webs of the zip fastener halves may be elasticated to allow the spacing between the teeth to be varied. In this case, the teeth may be engaged by identical sprockets mounted on the ends of shafts positioned upstream and downstream of the impression surface in place of the stretch resistance rollers 92. If a conical impression cylinder 90 is being used, a sprocket mounted on the larger diameter end of the conical impression cylinder 90 may have teeth that are more widely spaced apart to stretch the ITM 30.

In some embodiments a mechanism may be used to prevent the ITM 30 from sliding off of one or both lateral edges of the impression surface. Examples of such a mechanism include lateral guides or channels, sprockets, and zip fasteners-like teeth, lateral projections, beads and the like able to be associated with any of the foregoing exemplary guiding mechanisms, or mechanical barriers such as rims protruding at the edges of the impression surface, etc. For a cylindrical object, the ITM may be equally likely to slide off either lateral edge of the impression surface, and therefore a mechanism may be deployed to prevent sliding off of either lateral edge. For a conical object, the ITM may be more likely to slip transversely to the direction of movement of the ITM 30 from the most stretched side to the least or unstretched side and slide off of the lateral edge of the impression surface facing the smaller diameter end of the conical object.

Figure 10:
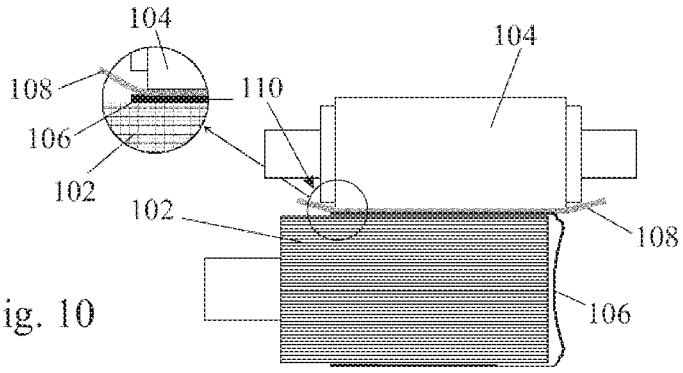
FIG. 10 shows a detail of the nip that avoids the blanket being damaged by contacting a sharp edge of an object.

When printing using an ITM formed by a continuous blanket onto the outer surface of cans, damage may be caused to the blanket, if allowed to contact the sharp edges of the cans. FIG. 10 shows a nip that is designed to avoid this problem and may be used in any of the above described embodiments of the invention. In FIG. 10, a can 106 supported on a mandrel 102 contacts a blanket 108 that is compressed between the can 106 and an impression cylinder 104. In this figure, blanket 108 corresponds to a lateral cross section of an ITM 30 as illustrated in previous figures. Instead of an impression cylinder 104, alternative embodiments could employ a stationary anvil, or a rotatable impression drum as has been described above. The axial end of the impression cylinder 104 (or anvil, or rotatable drum) stops short of reaching the sharp open end of the can 106, leaving a lateral edge of the blanket unsupported by the impression cylinder 104. As a result, in the region designated 110, the blanket 108 separates from the can 106 before it comes into contact with the sharp edge. In the figure, the can is illustrated as having an open end only on one side rendering the proposed design unnecessary for the closed end that is typically devoid of sharp angles. For 3D objects that have sharp edges at both ends, the above design of having the impression surface adapted to avoid reaching such edges so as to prevent contact with the ITM, can be implemented at both axial ends of the impression surface. This solution can also be implemented for substantially 2D objects whose thickness, while being insignificant for the overall perception of the shape of the object, can nevertheless yield edges that would be sharp or in any way damaging when contacting the ITM. By way of example, the aforesaid method can be beneficial for printing on lids of such cans.

While many of the figures of the accompanying drawings have been drawn to illustrate printing on cylindrical objects each of the illustrated embodiments may readily be adapted for printing on non-cylindrical objects such as conical objects by causing unilateral stretching of the ITM as it passes through the nip. Thus, in FIGS. 2 and 3 the pads 22 may be segments of a frusto-conical surface rather than a cylinder. In FIGS. 2 and 3, the impression surface that is the outer surface of rotatable drum 24, or in FIGS. 4 and 5, the impression surface that is the outer surface of the roller 56, or in FIGS. 6 to 8 the impression surface of the anvil, may be inclined relative to the axis of rotation of the conical object during passage of the conical object through the impression station (so as to accommodate the slant of the outer surface of the conical object). The roller having an outer surface that serves as the impression surface in FIGS. 4 and 5 may be conical or cylindrical. In all embodiments, inclined guide surfaces may be provided upstream and/or downstream of the impression station to elongate one side of the ITM relative to the other, regardless of whether the inner surface of the ITM is in rolling contact or sliding contact with the impression surface.

The apparatus herein disclosed offer numerous advantages and can mitigate the problems associated with the known apparatus, as outlined above. In particular, images that may be applied can include any processed color that can be blended from primary colors (i.e., Cyan (C), Magenta (M), Yellow (Y), typically also including a key Black (K)), obviating the limitations imposed by using only non-processed colors and/or the need for stocks of numerous specialty colors each adapted to a particular object. The colors need not be separated from one another, the resulting image having therefore a more contiguous appearance, generally more appealing and considered of a high quality. As the images are digitally created, each ink image jetted on the release surface of the ITM may differ from a previous image, allowing for short runs of any particular print job (i.e. a same image on a similar object), which could even allow customization of individual objects, if desired. The time saving and other operational advantages afforded by such apparatus can be readily appreciated by persons skilled in the art of commercial printing.

In the description and claims of the present disclosure, each of the verbs, "comprise" "include" and "have", and conjugates thereof, are used to indicate that the object or objects of the verb are not necessarily a complete listing of members, components, elements, steps or parts of the subject or subjects of the verb.

As used herein, the singular form "a", "an" and "the" include plural references and mean "at least one" or "one or more" unless the context clearly dictates otherwise.

Positional or motional terms such as "upper", "lower", "right", "left", "bottom", "below", "lowered", "low", "top", "above", "elevated", "high", "vertical", "horizontal", "front", "back", "backward", "forward", "upstream" and "downstream", as well as grammatical variations thereof, may be used herein for exemplary purposes only, to illustrate the relative positioning, placement or displacement of certain components, to indicate a first and a second component in present illustrations or to do both. Such terms do not necessarily indicate that, for example, a "bottom" component is below a "top" component, as such directions, components or both may be flipped, rotated, moved in space, placed in a diagonal orientation or position, placed horizontally or vertically, or similarly modified.

Unless otherwise stated, the use of the expression "and/or" between the last two members of a list of options for selection indicates that a selection of one or more of the listed options is appropriate and may be made.

In the disclosure, unless otherwise stated, adjectives such as "substantially" and "about" that modify a condition or relationship characteristic of a feature or features of an embodiment of the present technology, are to be understood to mean that the condition or characteristic is defined to within tolerances that are acceptable for operation of the embodiment for an application for which it is intended or within variations expected from the measurement being performed and/or from the measuring instrument being used. When the term "about" precedes a numerical value, it is intended to indicate +/−15%, or +/−10%, or even only +/−5%, and in some instances the precise value.

While this disclosure has been described in terms of certain embodiments and generally associated methods, alterations and permutations of the embodiments and methods will be apparent to those skilled in the art. The disclosure of the invention is to be understood as not limited by the specific embodiments described herein.

To the extent necessary to understand or complete the disclosure of the present invention, all publications, patents, and patent applications mentioned herein, are expressly incorporated by reference in their entirety as is fully set forth herein.

Citation or identification of any reference in this application shall not be construed as an admission that such reference is available as prior art to the invention.

I claim:

1. A method of printing on an outer surface of a three-dimensional object having a longitudinal axis, the method comprising:

depositing on a release surface of an intermediate transfer member (ITM) having the form of a flexible endless belt at least one ink composition that comprises a coloring agent, a resin and an optional liquid carrier to form an ink image at an imaging station;

substantially drying the ink image, by evaporation of any liquid carrier in the ink or by exposure to radiation to at least partially cure the ink, so as to form a dried ink image on the release surface; and compressing, at a nip of an impression station, the ITM between an object and an impression surface, so that the dried image is transferred from the release surface of the ITM to an outer surface of the object, wherein the object rotates about its own longitudinal axis during passage through the impression station such that, at the nip, the outer surface of the object makes rolling contact with the release surface of the ITM, and wherein the impression surface forms part of a stationary anvil, the ITM sliding relative to the impression surface during passage through the impression station and a compressible member enhancing the contact between the dried ink image carried by the release surface of the ITM and the surface of the object.

2. The method of claim 1, wherein a velocity of the ITM relative to the surface of the object at the impression station is greater than a velocity of the ITM relative to the imaging station.

3. The method of claim 2, wherein the ITM travels at the impression station at a higher velocity than at the imaging station and wherein buffers are provided to accommodate velocity differences.

4. The method of claim 2, wherein, at the impression station, a direction of movement of objects by the object transport system is opposite to a movement of the ITM at the impression station, a velocity of movement of the ITM being uniform over its entire length.

5. The method of claim 1, wherein the impression surface is concave in a direction facing the object.

6. The method of claim 1, wherein the impression surface is convex in a direction facing the object.

7. The method of claim 1, wherein the impression surface has a length, measured in a direction of movement of the ITM, that is shorter than a circumference of the object.

8. The method of claim 1, further comprising, prior to forming the ink image, conditioning the release surface to facilitate at least one of a retention of the ink image on the release surface during transit from the imaging station to the impression station and a transfer of the dried ink image from the ITM to the surface of the object.

9. The method of claim 8, wherein the release surface is chemically conditioned, the conditioning including the application of a thin layer of a treatment liquid upon the release surface, the thin layer being substantially dry upon entry of the ITM into the imaging station.

10. The method of claim 1, further comprising pre-processing at least a portion of the surface of the object prior to passage of the object through the impression station.

11. The method of claim 1, further comprising post-processing at least a portion of the surface of the object after transferring the dried ink image to the surface of the object.

12. The method of claim 1, wherein the ITM is fiber-reinforced so as to be substantially non-extendible.

13. The method of claim 1, wherein the ITM is elastically deformable during passage through the impression station to permit printing on a non-cylindrical object surface.

14. The method of claim 13, wherein the ink image formed at the imaging station on the release surface is a distorted mirror image of the image to be transferred to the object, the distortion compensating for stretching of the ITM.

15. The method of claim 1, further comprising reducing a temperature of the ITM after transferring the dried ink image to the object.

16. The method of claim 1, further comprising cleaning the release surface of the ITM after transfer of the dried ink image.

17. The method of claim 1 wherein the release surface of the ITM is hydrophobic.

18. The method of claim 1, wherein the ink composition is aqueous.

19. The method of claim 1, wherein, at the impression station, no part of the impression surface opposes any sharp edge of the object.

20. The method of claim 1, wherein the compressible member includes at least one of i) a compressible blanket pad positioned on the impression surface and shaped in accordance with a shape of the object; and ii) a compressible layer within the ITM, the compressible layer being optionally an underlying layer distinct from the release surface.

* * * * *